US005079786A

United States Patent [19]

Rojas

[11] Patent Number: 5,079,786

[45] Date of Patent: Jan. 14, 1992

[54] CUSHION WITH MAGNETIC SPHERES IN A VISCOUS FLUID

[76] Inventor: Adrian Q. Rojas, 623 E. Shrode, Duarte, Calif. 91010

[21] Appl. No.: 729,177

[22] Filed: Jul. 12, 1991

[51] Int. Cl.[5] ..... A47C 27/08

[52] U.S. Cl. ..... 5/450; 5/451

[58] Field of Search ..... 5/450, 451, 449, 441, 5/422, 448; 297/DIG. 3

[56] References Cited

U.S. PATENT DOCUMENTS

| | | | |
|---|---|---|---|
| 3,748,669 | 7/1973 | Warner | 5/451 |
| 4,213,213 | 7/1980 | Burnett | 5/450 |
| 4,728,551 | 3/1988 | Jay | 5/450 |

FOREIGN PATENT DOCUMENTS

| | | | |
|---|---|---|---|
| 2431431 | 1/1976 | Fed. Rep. of Germany | 5/450 |

*Primary Examiner*—Alexander Grosz
*Attorney, Agent, or Firm*—Leon Gilden

[57] ABSTRACT

A cushion apparatus includes an enclosed cushion member defining an interior cavity defined by a top wall spaced from and parallel a bottom wall, with a surrounding side wall coextensive therebetween. A portal opening is directed through the side wall, with the cushion including a viscous fluid such as oil defining a medium therewithin floatingly receiving hollow spheres of varying sizes that are deformably constructed in floation with the viscous fluid. The viscous fluid volume is less than a further volume defined by the internal cavity of the cushion, and the hollow spheres define a spherical volume total less than the volume of the viscous fluid. A modification of the invention includes resilient spheres mounted within the fluid medium of varying diameters, with a ferromagnetic rod mounted diametrically aligned within each sphere, with each rod extending a length less than a predetermined diameter of each associated sphere, with a north pole of each sphere extending coextensively along with an outer surface of sphere to effect magnetic repulsion and constant agitation with the cushion in use.

3 Claims, 4 Drawing Sheets

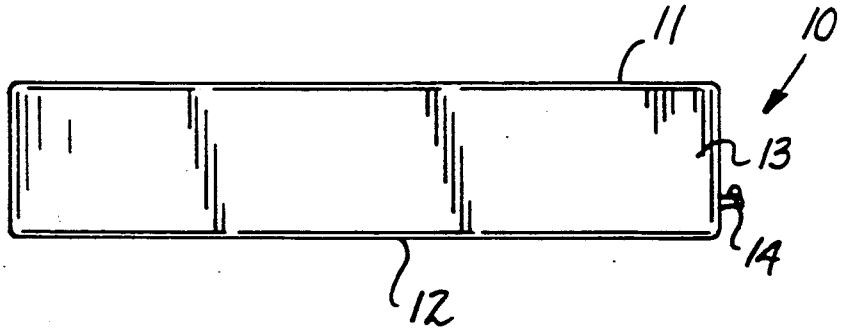
FIG 1
FIG 2
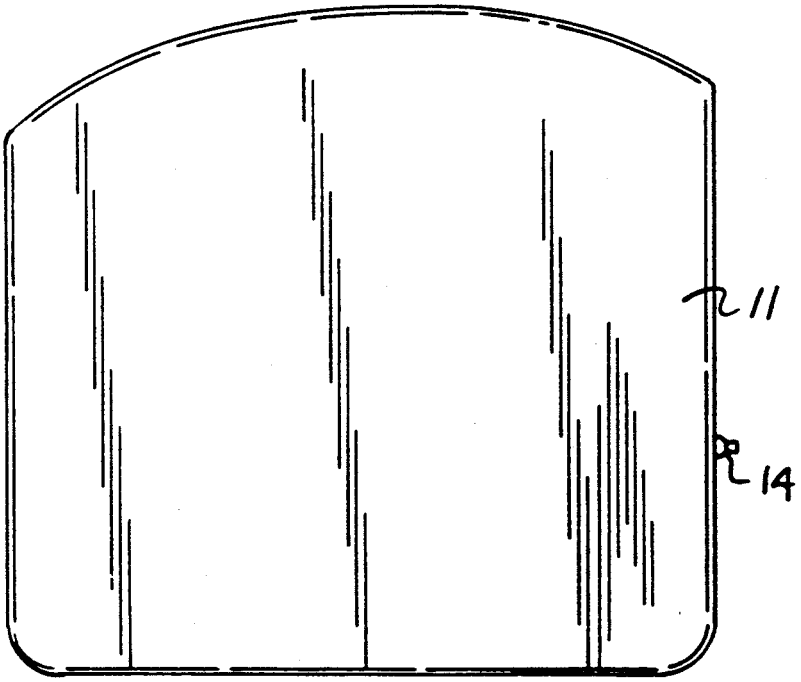

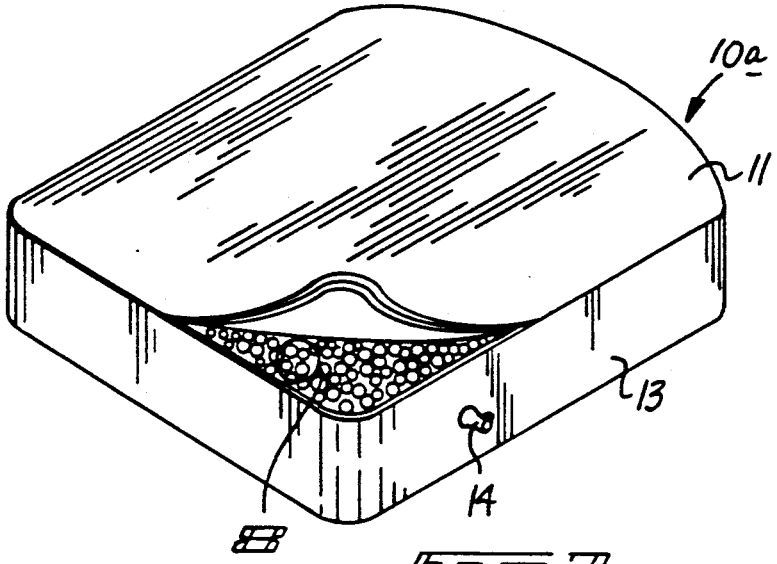
Fig 7
Fig 8
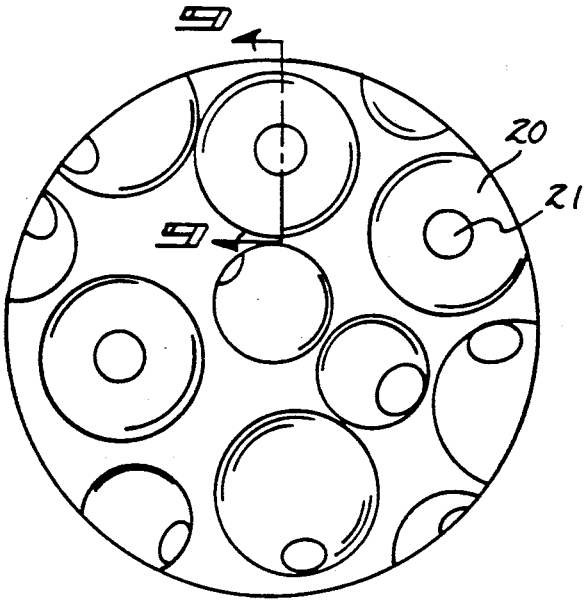
Fig 9
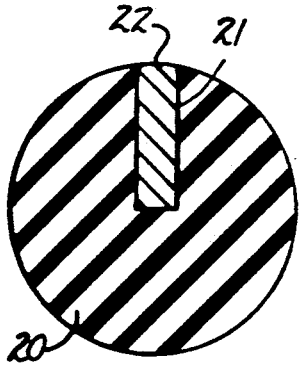

CUSHION WITH MAGNETIC SPHERES IN A VISCOUS FLUID

BACKGROUND OF THE INVENTION

1. Field of the Invention

The field of invention relates to cushion apparatus, and more particularly pertains to a new and improved cushion apparatus wherein the same is arranged for providing enhanced comfort in sitting upon an associated cushion apparatus.

2. Description of the Prior Art

Various cushion apparatus is utilized in the prior art to provide comfort during extended sittings for various individuals involved, such as truck drivers, teachers and the like. Cushion apparatus exemplified in the prior is set forth in U.S. Pat. No. 4,726,624 to Jay wherein a seat cushion utilizes a plurality of layers mounted thereon, wherein the cushion is formed of a convex surface to accommodate an individual's physical configuration.

U.S. Pat. No. 4,862,535 to Roberts sets forth a pillow apparatus utilizing baffles and filler material therewithin.

U.S. Pat. No. 4,502,234 to Schaefer, et al. sets forth a support material utilizing foam materials of various resiliency, as well as a liquid strata.

U.S. Pat. No. 4,753,705 to Poncy sets forth a cushion with a fluid central core.

U.S. Pat. No. 4,847,931 to Bard sets forth a pillow utilizing a fluid filled cavity within the cushion structure.

As such, it may be appreciated that there continues to be a need for a new and improved cushion apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cushion apparatus now present in the prior art, the present invention provides a cushion apparatus wherein the same is arranged to contain spherical members floatingly mounted within a viscous fluid medium. As such, the general purpose of the present invention, which will be described subsequently in greater detail, is to provide a new and improved cushion apparatus which has all the advantages of the prior art cushion apparatus and none of the disadvantages.

To attain this, the present invention provides a cushion apparatus including an enclosed cushion member defining an interior cavity defined by a top wall spaced from and parallel a bottom wall, with a surrounding side wall coextensive therebetween. A portal opening is directed through the side wall, with the cushion including a viscous fluid such as oil defining a medium therewithin floatingly receiving hollow spheres of varying sizes that are deformably constructed in flotation with the viscous fluid. The viscous fluid volume is less than a further volume defined by the internal cavity of the cushion, and the hollow spheres define a spherical volume total less than the volume of the viscous fluid. A modification of the invention includes resilient spheres mounted within the fluid medium of varying diameters, with a ferromagnetic rod mounted diametrically aligned within each sphere, with each rod extending a length less than a predetermined diameter of each associated sphere, with a north pole of each sphere extending coextensively along with an outer surface of sphere to effect magnetic repulsion and constant agitation with the cushion in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cushion apparatus which has all the advantages of the prior art cushion apparatus and none of the disadvantages.

It is another object of the present invention to provide a new and improved cushion apparatus which may be easily and efficiently manufactured and marketed.

It is a further object of the present invention to provide a new and improved cushion apparatus which is of a durable and reliable construction.

An even further object of the present invention is to provide a new and improved cushion apparatus which is susceptible of a low cost of manufacture with regard to both materials and labor, and which accordingly is then susceptible of low prices of sale to the consuming public, thereby making such cushion apparatus economically available to the buying public.

Still yet another object of the present invention is to provide a new and improved cushion apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view of the instant invention.

FIG. 2 is an orthographic top view of the instant invention.

FIG. 6 is an orthographic cross-sectional illustration of the invention, taken along the lines 6—6 of FIG. 3 in the direction indicated by the arrows.

FIG. 7 is an isometric view of a modification of the invention.

FIG. 8 is an enlarged orthographic view of section 8, as set forth in FIG. 7.

FIG. 9 is an orthographic view, taken along the lines 9—9 of FIG. 8 in the direction indicated by the arrows.

DESCRIPTION OF THE PREFERRED EMBODIMENT

Figure 3:
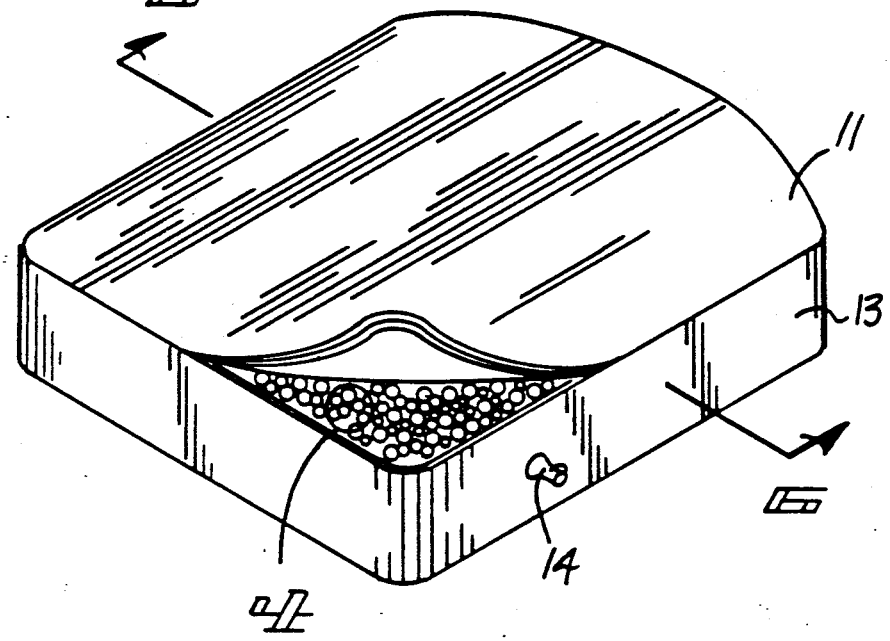
FIG. 3 is an isometric view of the invention, with a top layer partially separated therefrom to permit viewing interiorly thereof.
Figure 4:
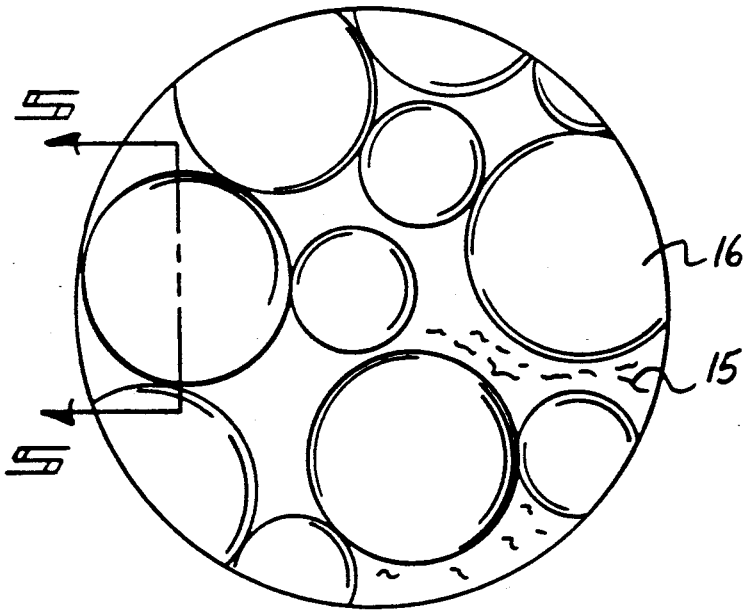
FIG. 4 is an enlarged orthographic view of section 4, as set forth in FIG. 3.
Figure 5:
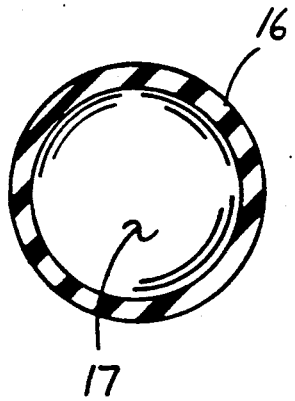
FIG. 5 is a cross-sectional illustration of a spherical member utilized by the instant invention.
Figure 3:
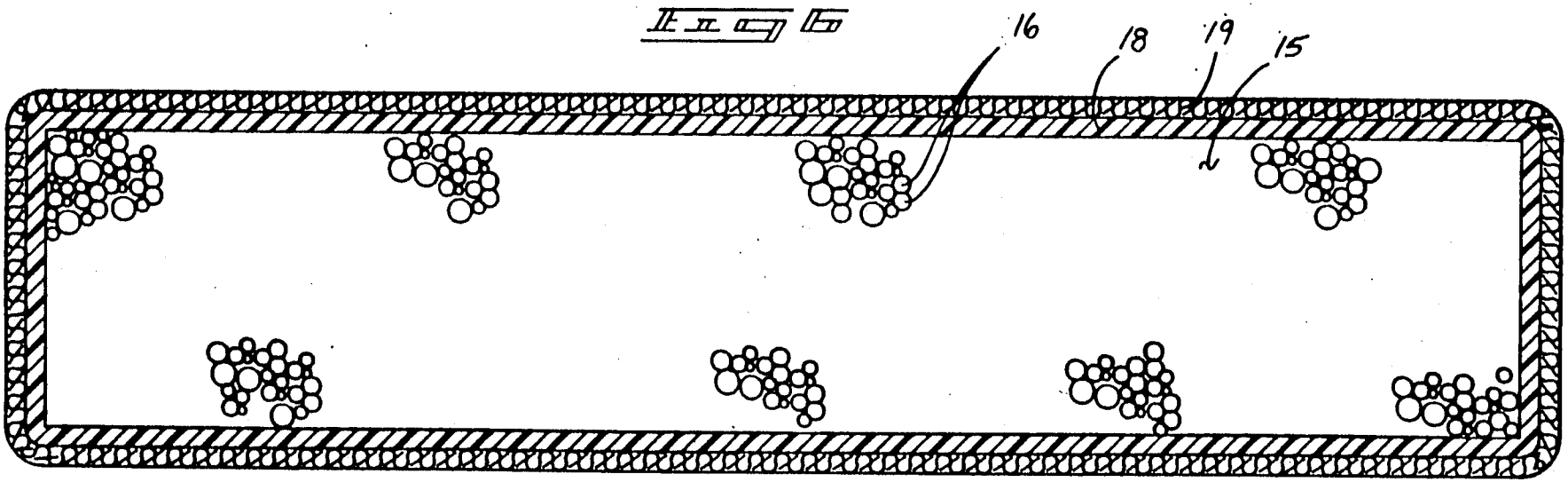

With reference now to the drawings, and in particular to FIGS. 1 to 9 thereof, a new and improved cushion apparatus embodying the principles and concepts of the present invention and generally designated by the reference numerals 10 and 10a will be described.

More specifically, the cushion apparatus 10 of the instant invention essentially comprises a flexible housing defined by a top wall spaced from and parallel a bottom wall 12, with a side wall 13 coextensively directed between the top and bottom wall. The side wall includes a portal opening 14 which may optionally be covered by a fibrous outer lining 19 (see FIG. 6) if desired. The portal opening 14 is arranged for permitting filling and emptying of contents within the cavity housing defined within the cushion construction. A viscous fluid 15, such as oil, defines a fluid medium within the cavity of the cushion, wherein the cushion cavity defines a predetermined first volume and the fluid medium defines a second volume less than the first volume to permit fluid displacement upon an individual's sitting upon the cushion structure. The viscous fluid medium 15 includes a plurality of deformable polymeric spheres 16 of varying diameters within the fluid medium to provide cushioning upon an individual's sitting upon the top wall 11. The spheres are of varying diameters and define a third volume less than the second volume to permit displacement of the spheres, wherein further, the spheres are defined by a specific gravity less than that defined by the fluid medium to effect flotation of the spheres upwardly within the medium to provide enhanced cushioning and accommodation of an individual sitting upon the top wall 11.

As illustrated in FIG. 6, the cushion apparatus 10 includes a fluid impermeable housing 18 surroundingly formed about the cavity of the cushion, with a fibrous outer liner 19 formed coextensively thereabout to provide absorption and enhanced comfort in use of the cushion structure.

A modified apparatus is set forth and illustrated in FIGS. 7-9, wherein the use of modified resilient spheres 20 are provided defined by a predetermined diameter. Each modified sphere 20 includes a ferromagnetic rod 21 defined by a predetermined length less than the predetermined diameter diametrically aligned within each sphere 20, with a north pole end 22 of each magnetic rod 21 arranged coextensive on an exterior surface of each sphere to effect displacement and rotation of each sphere relative to one another as they are projected towards one another to enhance agitation within the medium 15 and provide constant turbulence within the medium to provide for turbulence of the spheres within the medium and enhance comfort to an individual seated upon the top wall 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cushion apparatus, comprising, a top wall spaced from and coextensive with a bottom wall, with a side wall coextensively directed between the top wall and bottom wall defining a cavity between the top wall, the bottom wall, and side wall, and the side wall including a portal opening permitting access interiorly of the cavity, and a viscous fluid medium contained within the cavity, and a plurality of spheres contained within the viscous fluid medium the cavity being defined by a first volume and the viscous fluid medium being defined by a second volume less than the first volume and the spheres define a third volume less than the second volume to permit displacement of the viscous fluid medium and the spheres within the cavity each sphere including a ferromagnetic rod diametrically aligned within each sphere and defined by a length less than the predetermined diameter of each sphere wherein each rod includes a north pole end the north pole end being coextensively arranged with an outer surface of the sphere to effect continuous agitation of the spheres as they are projected towards one another.

2. An apparatus as set forth in claim 1 wherein the spheres are of a hollow polymeric deformable construction of varying diameters.

3. An apparatus as set forth in claim 1 wherein the spheres are defined by a specific gravity less than a fluid medium specific gravity defined by the viscous fluid medium to effect relative flotation of the spheres within the viscous fluid medium.

* * * * *